US007222383B2

(12) United States Patent
Hale

(10) Patent No.: US 7,222,383 B2
(45) Date of Patent: May 29, 2007

(54) TORQUE LIMITING DRIVE PULLEY FOR A BELT DRIVEN DRAIN CLEANING MACHINE

(76) Inventor: C. David Hale, 1126 Sylvan Dr., Wilmington, OH (US) 45177

( * ) Notice: Subject to any disclaimer, the term of this patent is extended or adjusted under 35 U.S.C. 154(b) by 596 days.

(21) Appl. No.: 10/404,239

(22) Filed: Apr. 1, 2003

(65) Prior Publication Data

US 2004/0194241 A1 Oct. 7, 2004

(51) Int. Cl.
*B08B 9/045* (2006.01)

(52) U.S. Cl. ..... 15/104.33; 15/104.31

(58) Field of Classification Search ..... 15/104.31, 15/104.33

See application file for complete search history.

(56) References Cited

U.S. PATENT DOCUMENTS 2,926,372 A * 3/1960 O'Brien ..... 15/104.33
5,265,301 A * 11/1993 Irwin ..... 15/104.33

* cited by examiner

*Primary Examiner*—Randall Chin
(74) *Attorney, Agent, or Firm*—Frost Brown Todd LLC

(57) ABSTRACT

A belt driving pulley, as typically used in a belt driven, drum-type drain cleaning machine and/or any other belt driven machinery, is disclosed wherein slippage between the pulley and the motor drive shaft occurs if a predetermined resisting torque is applied to the pulley by the belt.

10 Claims, 5 Drawing Sheets

TORQUE LIMITING DRIVE PULLEY FOR A BELT DRIVEN DRAIN CLEANING MACHINE

BACKGROUND OF THE INVENTION

The present invention generally relates to sewer cleaning machines having a belt driven drum, or basket, which typically stores therein, and drives, a pipe cleaning cable or ""snake"." More particularly the present invention teaches a unique and novel friction, clutch driven, pulley attached to the output shaft of the driving electric motor, or other prime mover, whereby the friction clutch will slip upon encountering a predetermined resisting torque, thereby preventing damage to the "snake" should the "snake" encounter extreme resistance outside the design parameters of the sewer cleaning machine and/or cable.

DESCRIPTION OF PRIOR ART

Torque limiting mechanisms have been used in prior art sewer cleaning machines to protect the sewer cleaning cable, or "snake", from being damaged if the sewer cleaning "snake" encounters an extreme torque, or resistance, whereby the yield point of the "snake" material may be exceeded. Generally the prior art torque limiting mechanisms fall into two categories, axial in-line mechanisms positioned in-line with the cleaning cable and pulley mechanisms attached to the driving motor's torque out-put, or drive, shaft. Following are typical prior art patents relating to both types of mechanisms:

In-line Mechanisms:

U.S. Pat. No. 3,574,878 issued on Apr. 13, 1971 to Harold S. Ardsley for a "Power Rooter With Safety Clutch" teaches an in-line clutch assembly having diametrically, spring loaded clutch elements (balls) that cooperate with axial grooves that circumferentially slip upon experiencing a predetermined resistance torque.

U.S. Pat. No. 3,742,548 issued on Jul. 3, 1973 to Peter L. Ciaccio for a "Safety Overload Clutch For Sewer-Rodding Machines and the Like, With Loading Indicator" discloses a pair of axial, in-line, "ratchet" toothed couplings, biased together by a coil spring that slidingly slip, with respect to one another, upon experiencing a predetermined limiting torque.

U.S. Pat. No. 5,618,123 issued on Apr. 8, 1997 to Robert Pulse for a "Coupling Device For Sewer And Drain Cleaning Cable" teaches an in-line coupling having diametrical shear pins that shear when the coupling experiences a predetermined torque.

U.S. Pat. No. 5,657,505 issued to Michael P. Gallagher et al. on Aug. 19, 1997 for a "Drain Cleaning Apparatus" discloses a drain cleaning machine having an engaging/disengaging double cone clutch by which the operator may manually engage and/or disengage the motor drive shaft from the sewer cleaning "snake" during the sewer cleaning operation.

Drive Pulley Mechanisms:

U.S. Pat. No. 5,033,990 issued to Arthur Silverman on Jul. 23, 1991 for a "Pulley Having Spring Loaded Release Mechanism" teaches a split V-belt pulley assembly, axially biased together by a helical spring, whereby the pulley sheaves are caused to axially separate when a predetermined torque, acting upon the V-belt passing between the pulley sheaves, is surpassed thereby permitting the V-belt to slip with respect to the pulley sheaves.

U.S. Pat. No. 6,381,798 issued to Michael J. Rutkowski et al. for a "Spring Clutch For Drain Cleaning machines" on May 7, 2002 teaches a belt driven drum-type drain cleaning machine in which the driving motor supports are spring biased to tension the drive belt whereby drive belt slippage occurs in response to the imposition of a predetermined torque on the drain cleaning cable during use of the machine.

BRIEF SUMMARY OF THE INVENTION

The present invention generally relates to a drain cleaning machine of the belt driven, drum-type, design. More specifically, the present invention discloses a belt driving pulley assembly, attached to and rotating with the motor drive shaft, wherein the pulley will slip, with respect to the motor drive shaft, if a predetermined resisting torque is applied to the pulley by the drive belt.

The torque limiting pulley comprises a central hub having a radially extending rotor preferably at one end thereof. Rotably positioned upon the central hub, adjacent the rotor, is a V groove pulley preferably having a lubricant impregnated bearing positioned between the inside diameter of the pulley and the external diameter of the central hub, whereby the pulley may be permitted to rotate independently of the central hub.

A first friction material disc, coaxial with the central hub, is positioned between the pulley and the rotor. A second friction material disc, also coaxial with the central hub, is positioned on the opposite side of the pulley whereby the pulley is contiguously interposed between the first and second friction material discs.

A pressure plate disc, coaxial with the central hub, positioned on the opposite side of the second friction material disc, is spring biased toward the second friction material disc whereby the axial force applied to the pressure plate disc causes the pulley to be frictionally held between the rotor and the pressure plate disc. Thus the pulley will rotate with the motor drive shaft until a predetermined resisting torque is applied to the pulley by the drive belt, whereupon the pulley will slip between the first and second friction material discs thereby preventing over torquing the drain cleaning cable causing damage thereto and/or stalling the motor.

The torque value at which the pulley will slip between the first and second friction material discs, is determined by the axial spring force applied to the pressure plate disc by the biasing spring and the frictional properties of the friction material discs.

DETAILED DESCRIPTION OF THE INVENTION

Figure 1:
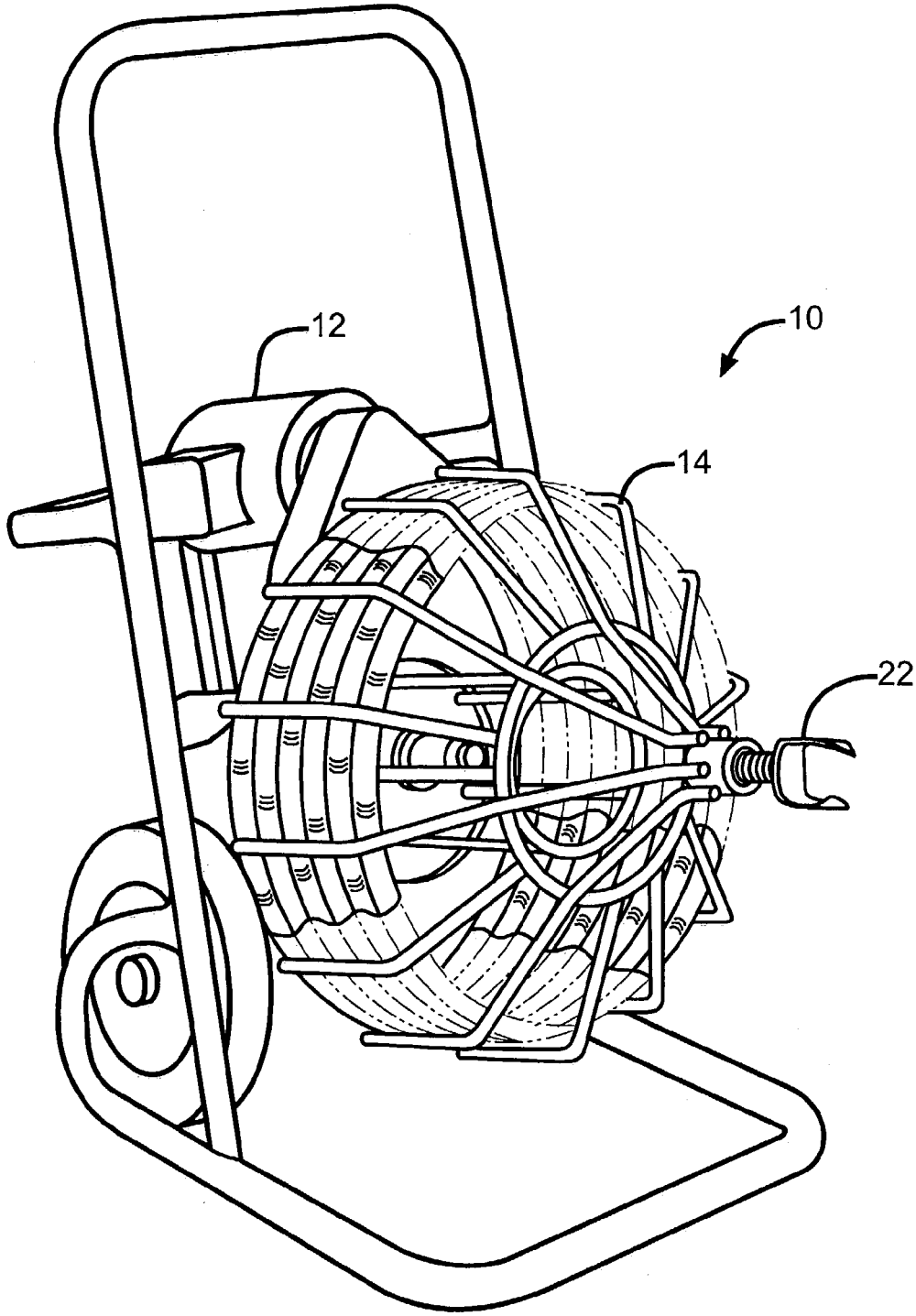
FIG. 1 presents a perspective view of a belt driven basket-type drain cleaning machine having a torque limiting clutch embodying the present invention.
Figure 2:
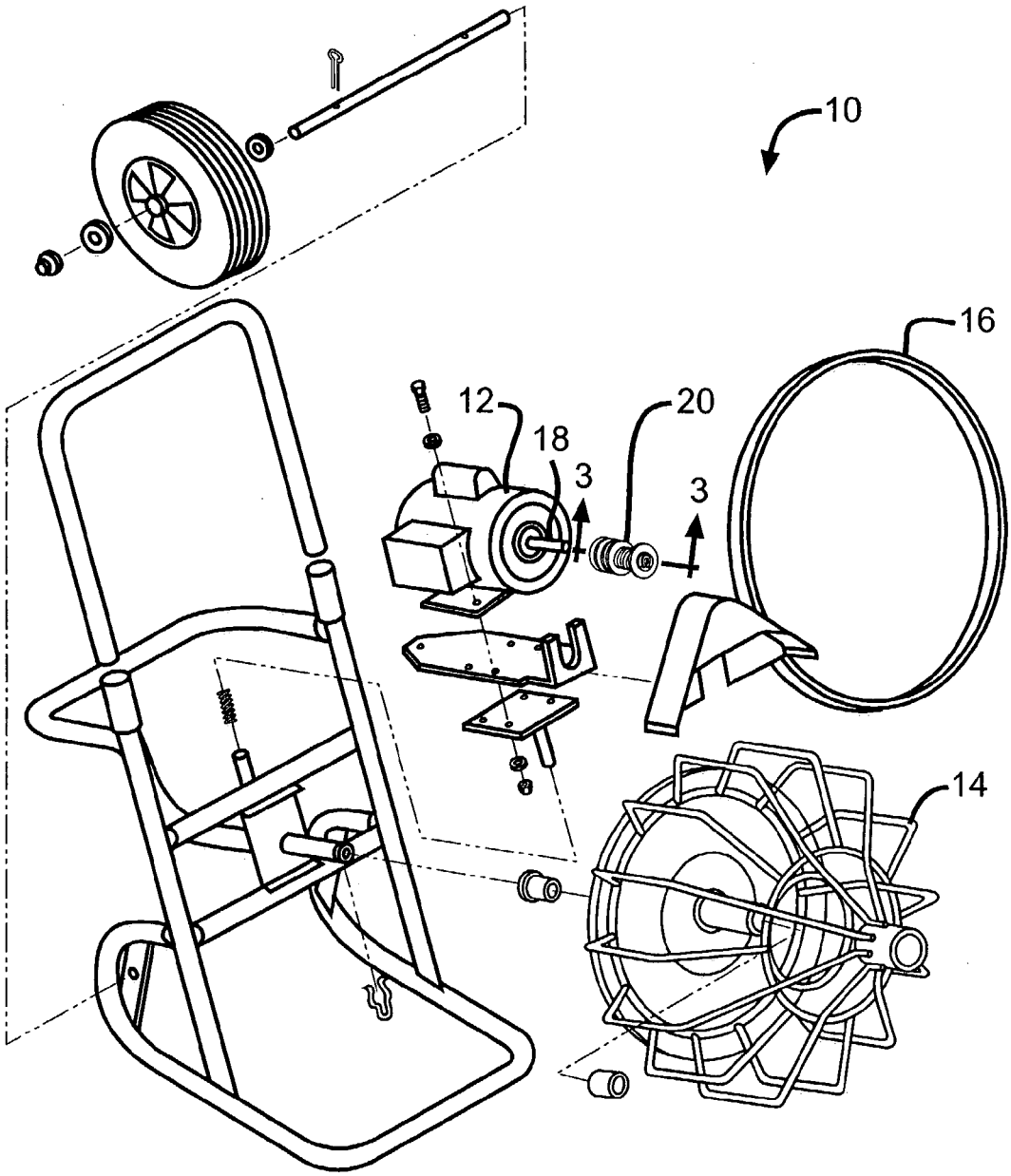
FIG. 2 presents an exploded perspective of the belt driven basket-type drain cleaning machine shown in FIG. 1.

FIGS. 1 and 2 present a typical belt driven basket-type drain cleaning machine 10 having an electric driving motor 12, driving basket 14 by way of an endless drive belt 16 typically wrapping about the circumference of basket 14. Attached to the out-put shaft 18 of motor 12, for driving belt 16, is clutch driven pulley assembly 20.

Figure 3:
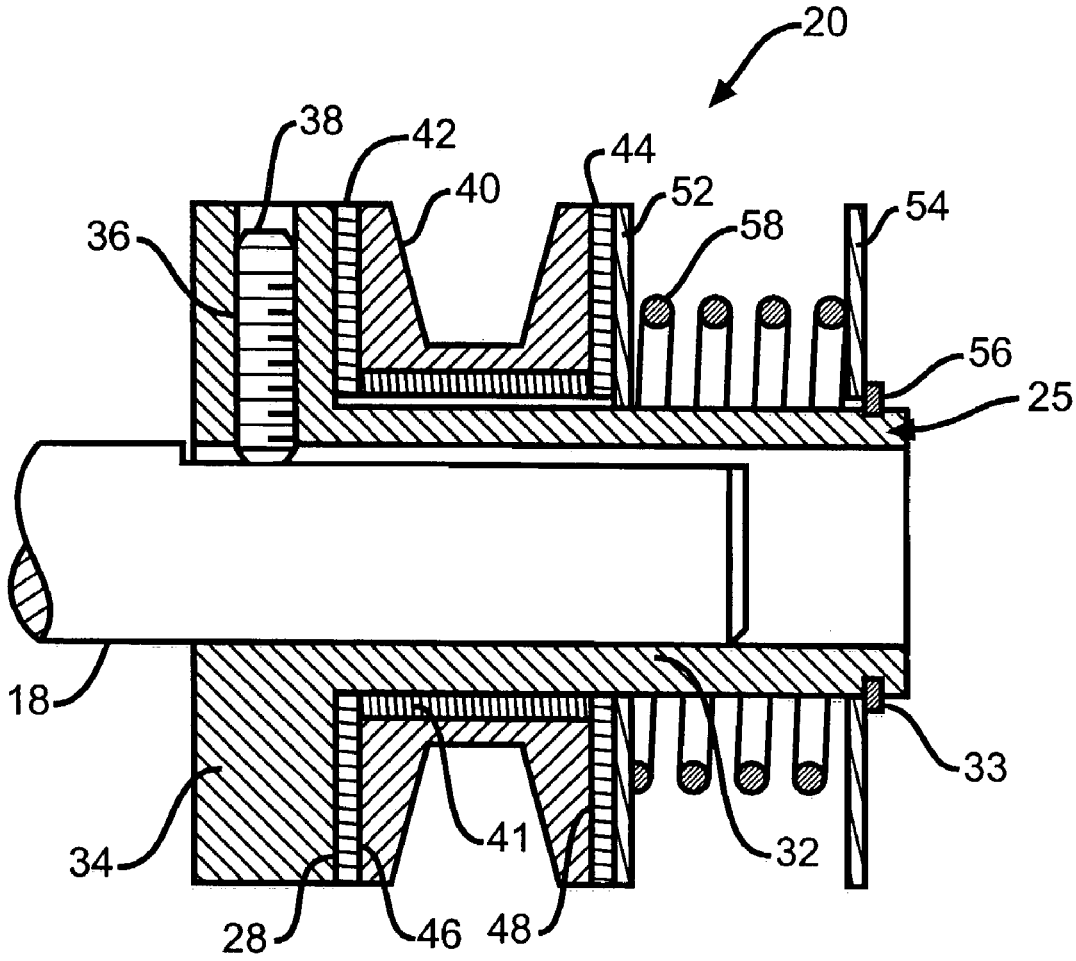
FIG. 3 presents a crossectional view taken along line 3-3 in FIG. 2 showing the elements and element arrangement of my torque limiting clutch driven pulley.
Figure 4:
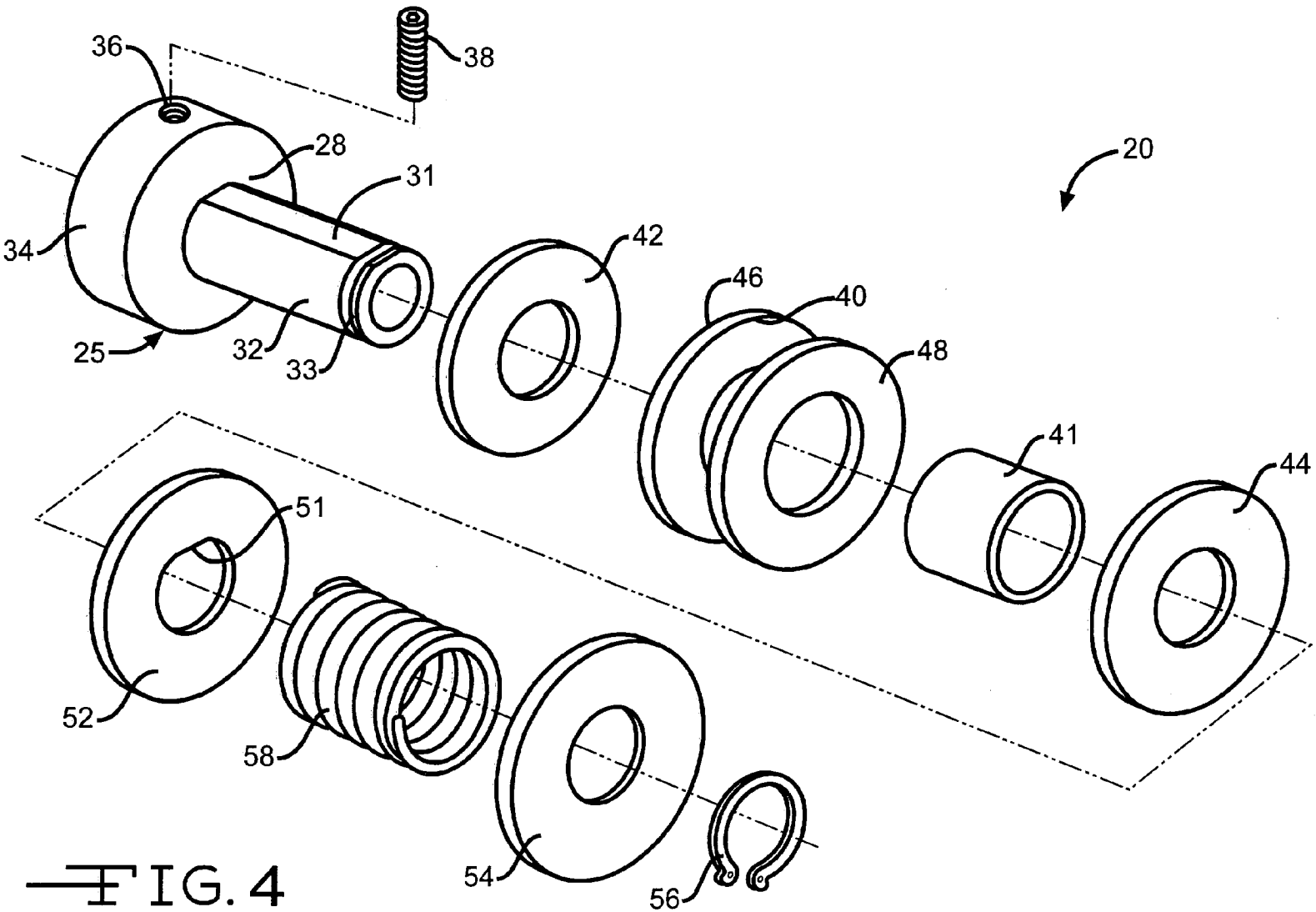
FIG. 4 presents an exploded perspective of the torque limiting clutch driven pulley shown in FIG. 3.

Referring now to FIGS. 3 and 4, pulley assembly 20 comprises a central hub 25 adapted to be mounted upon motor output shaft 18. Central hub 25 includes rotor 34 and cylindrical, or tubular, portion 32, receiving therein motor output shaft 18. Provided within rotor 34 is internally threaded bore 36 receiving therein set screw 38 for rigidly attaching central hub 25 to motor output shaft 18 as illustrated in FIG. 3.

Although a set screw 38 as illustrated in FIGS. 3 and 4 as a preferred method for attaching central hub 25 to motor output shaft 18, any other means may be used such as a "woodruff key," a splined motor output shaft with matching internal spline receiving grooves within the cylindrical portion of central hub 25, a diametrically orientated roll-pin extending through central hub 25 and the motor drive shaft 18 or any other suitable means for affixing a rotating element upon a rotatable drive shaft. However, if a "woodruff key" or the splined shaft coupling arrangement were to be used, additional means would necessarily have to be added to prevent axial movement of central hub 25 upon motor output shaft 18 such as a threaded retaining nut threaded upon the distal end of motor output shaft 18 similar to that shown in the alternate embodiment illustrated in FIG. 5.

Although rotor 34 is illustrated as being integral with cylindrical portion 32, rotor 34 may also be attached to cylindrical portion 32 by any other suitable means such as a "woodruff key" a splined coupling or any other suitable means for attaching rotating elements one to the other whereby they rotate as a single integral unit with motor output shaft 18. Further, although rotor 34 is illustrated as being at a distal end of tubular portion 32, rotor 34 may be positioned at any convenient axial location on tubular portion 32.

A rotatable V-groove pulley 40 is coaxially positioned upon the cylindrical portion 32 of central hub 25 as illustrated in FIG. 3.

Preferably an "OILITE" (OILITE is a registered trademark of Beemer Precision, Inc. of Fort Washington Pa.) oil impregnated bronze bearing 41, or equal, is positioned between the outer periphery of cylindrical portion 32 and the inside diameter of pulley 40 so that pulley 40 may rotate about cylindrical portion 32. A first friction disc 42 is coaxially positioned between rotor pressure plate 28 of rotor 34 and the first frictional face plate 46 of pulley 40. A second friction disc 44 is coaxially positioned between the second frictional face plate 48 of pulley 40 and coaxial pressure plate disc 52. Spaced axially apart from pressure plate disc 52, as illustrated in FIG. 3, is retaining disc 54. Pressure plate 52 is keyed to central hub 25 such that plate 52 and disc 54 rotate with central hub 25. Although pressure plate 52 is illustrated as being keyed to central hub cylindrical potion 32 by flat surface 51 of plate 52 received upon flat surface 31 of cylindrical portion 32, any other suitable method of assuring that plate 52 will rotate with cylindrical portion 32 may be used.

Retaining disc 54 may be typically retained upon cylindrical portion 32 of central hub 25 by a spring clip 56 positioned within circumferential groove 33.

A compression coil spring 58, coaxial with cylindrical portion 32 of central hub 25 is compressed between retaining disc 54 and pressure plate disc 52 thereby biasing pressure plate disc 52, pulley 40 and friction discs 42 and 44 towards rotor 34 of central hub 25.

By action of compression spring 58, pully 40 is frictionally hald between friction discs 42 and 44 such that as central hub 25 rotates with and upon motor output shaft 18, pulley 40 also rotates therewith driving belt 16, thereby rotating basket 14 which in turn rotates drain cleaning cable 20

Depending upon the frictional properties of friction discs 42 and 44, the frictional face plates of pulley 40, and the axial force provided by compression spring 58, pulley 40, will begin to slip when a predetermined threshold or limiting torque is experienced by cable 22.

Figure 5:
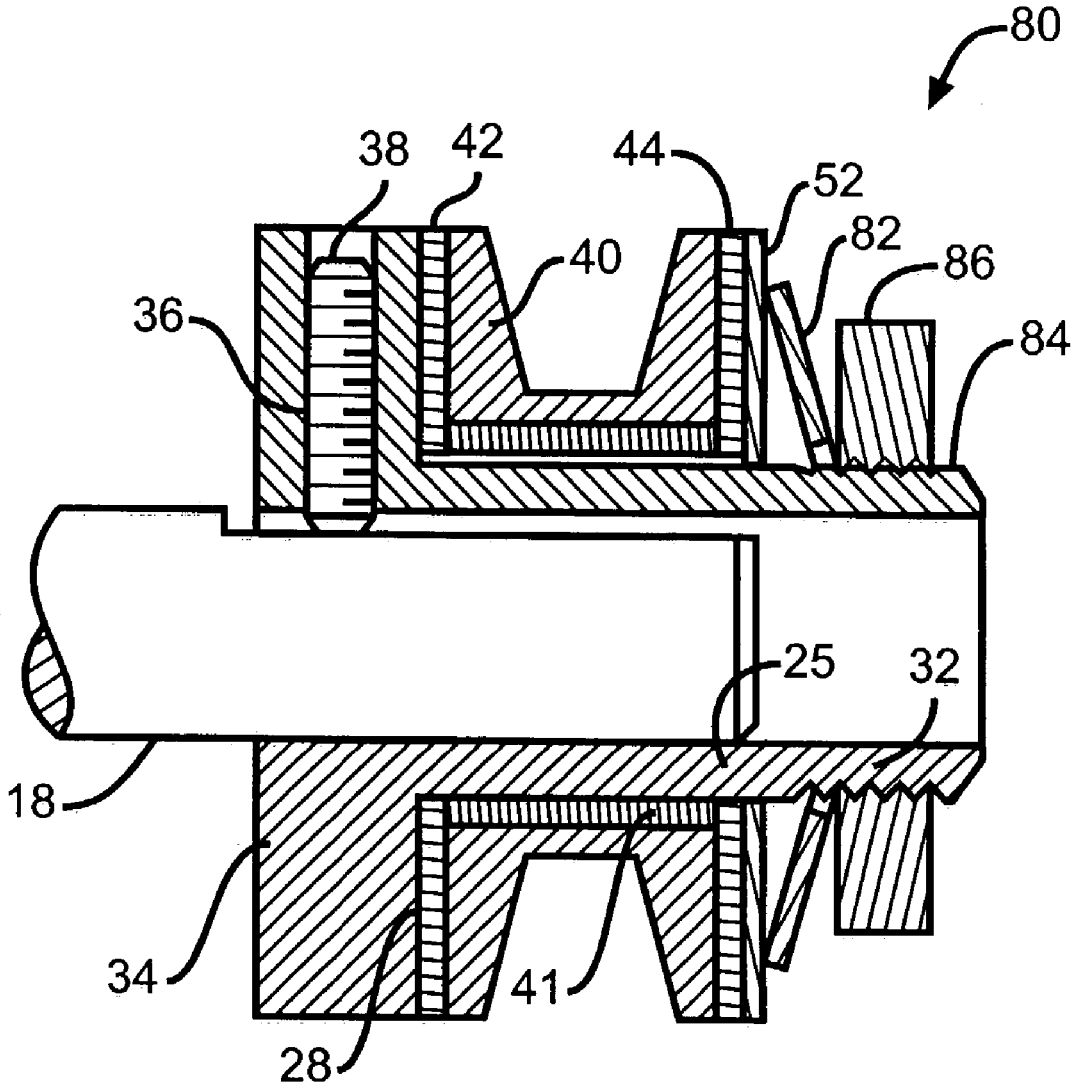
FIG. 5 presents a crossectional view similar to that shown in FIG. 3 illustrating an alternate embodiment of the present invention.

Turning now to FIG. 5, an alternate embodiment 80 of pulley assembly 20 is illustrated.

All commonly numbered elements, in FIGS. 3 through 5, are identical. However, in the alternate embodiment illustrated in FIG. 5, coil spring 58, retaining disc 54, groove 33, and spring clip 56 have been eliminated and belleville spring 82 has replaced coil 56 have been eliminated and belleville spring 82 has replaced coil spring 58. The free distal end of cylindrical portion 32, of central hub 25, is provided external helical threads 84 for receipt of self locking nut 86 thereon.

As self locking nut 86 is threaded onto cylindrical portion 32 belleville spring 84 is proportionately compressed thereby applying an axial force against pressure plate disc 52 whereby pulley 40 is frictionally held between friction discs 42 and 44 such that as central hub 25 rotates with and upon motor output shaft 18, pulley 40 also rotates therewith, thereby rotating basket 14 which in turn rotates drain cleaning cable 22.

Similar to the embodiment shown in FIGS. 3 and 4, pulley 40, will begin to slip when a threshold or limiting torque is experienced by cable 22.

Although FIGS. 3 and 4 teach use of a spring clip 56 and groove 33 to retain coil spring 58 between plates 52 and 54, it is also possible to use a self locking nut in their place as illustrated in the alternative embodiment illustrated in FIG. 5.

Use of a self locking nut, as illustrated in FIG. 5 in place of a groove 33 and spring clip 56, illustrated in FIGS. 3 and 4, permits varying the axial force applied to pressure plate 52 whereby the slip threshold of pulley 40 may be varied by varying the axial load applied to compression spring 58 and/or belleville spring 82. Whereas, by use of a coil spring 58 and a retaining spring clip 56 in groove 33 only one limiting resistive torque may be accommodated.

While I have described above the principles of my invention in connection with specific preferred embodiments, it is to be clearly understood that this description is made only by way of example and not as a limitation of the scope of my invention as set forth in the accompanying claims.

I claim:

1. A drain cleaning machine comprising:

a) a supporting frame, b) power source affixed to said supporting frame, said power source including a projecting drive shaft from which power may be extracted, c) a cable containing enclosure, supported upon said supporting frame, for rotation about an axis of rotation, said enclosure having axially spaced front and rear ends, said front end having an opening therethrough, d) a drain cleaning cable coiled within said enclosure about said axis of rotation, said cable including an end for extending through said opening and into a drain to be cleaned, e) torque limiting drive pulley means attached to said projecting drive shaft, f) a drive belt circumscribing said drive pulley means and said enclosure for rotating said enclosure and cable, g) said torque limiting drive pulley means comprising:

1) a central hub, said central hub including a tubular portion adapted to receive said drive shaft therein wherein said central hub rotates with said drive shaft, 2) a rotor affixed to and extending radially outward from said central hub, 3) a pulley mounted upon said tubular portion of said central hub wherein said pulley may independently rotate about said tubular portion of said central hub, 4) a first friction disc positioned between said pulley and said rotor, wherein said first friction disc is interposed between said rotor and said pulley, 5) a second friction disc axially positioned on the opposite side of said pulley, 6) an axially translatable pressure plate positioned upon said tubular portion of said central hub wherein said second friction disc is interposed between said pressure plate and said pulley, said pressure plate being non-rotatable with respect to said central hub, 7) means for applying a predetermined axial force upon said pressure plate wherein said pulley being frictionally held between said first and second friction discs rotates with said central hub until a predetermined resistive torque is applied to said pulley by said drive belt causing said pulley to slip between said first and second friction discs thereby preventing over-torquing of said cable.

2. The drain cleaning machine as claimed in claim 1 wherein said power source is an electric motor.

3. The drain cleaning machine as claimed in claim 1 wherein said power source is a gasoline engine.

4. The drain cleaning machine as claimed in claim 1 wherein said power source is a hand cranked driving mechanism.

5. The drain cleaning machine as claimed in claim 1 wherein said rotor is integral with said tubular portion of said central hub and positioned at one axial end of said tubular portion.

6. The drain cleaning machine as claimed in claim 5 wherein a lubricant impregnated bearing is interposed between said pulley and said tubular portion of said central hub.

7. The drain cleaning machine as claimed in claim 5 wherein said means for applying a predetermined axial force upon said pressure plate includes a coil spring coaxial with said tubular portion of said central hub.

8. The drain cleaning machine as claimed in claim 5 wherein said means for applying a predetermined axial force upon said pressure plate includes at least one belleville spring circumscribing said tubular portion of said central hub.

9. The drain cleaning machine as claimed in claim 8 wherein the distal end of said tubular portion of said central hub includes external threads and a threaded fastener threaded thereon whereby a variable axial force may be applied to said pressure plate as said fastener is threaded upon said tubular portion of said central hub.

10. The drain cleaning machine as claimed in claim 5 wherein said means for applying a predetermined axial force upon said pressure plate includes an external circumscribing groove positioned at the distal end of said tubular portion of said central hub, said groove having a removable spring clip therein, a retaining disc circumscribing said tubular portion positioned between said pressure plate disc and said spring clip, a coil spring coaxial with said tubular portion of said central hub positioned between said pressure plate disc and said retaining disc, said retaining disc being non-rotatable with respect to said central hub.

* * * * *